US005573445A

United States Patent [19]

Rasmussen et al.

[11] Patent Number: 5,573,445

[45] Date of Patent: Nov. 12, 1996

[54] LIQUID HONING PROCESS AND COMPOSITION FOR INTERFERENCE FRINGE SUPPRESSION IN PHOTOSENSITIVE IMAGING MEMBERS

[75] Inventors: Yonn K. Rasmussen, Fairport; Larry Sciarratta, Rochester; Ronald T. Kosmider, Fairport, all of N.Y.

[73] Assignee: Xerox Corporation, Stamford, Conn.

[21] Appl. No.: 298,802

[22] Filed: Aug. 31, 1994

[51] Int. Cl.[6] ..... B24B 1/00; B24C 1/00; G03G 5/04

[52] U.S. Cl. ..... 451/39; 430/69; 430/127

[58] Field of Search ..... 430/127, 69; 451/39

[56] References Cited

U.S. PATENT DOCUMENTS

| | | | |
|---|---|---|---|
| 4,076,564 | 2/1978 | Fisher | 216/52 |
| 4,134,763 | 1/1979 | Fujimura et al. | 430/69 |
| 4,390,611 | 6/1983 | Ishikawa et al. | 430/59 |
| 4,551,404 | 11/1985 | Hiro et al. | 430/59 |
| 4,588,667 | 5/1986 | Jones et al. | 430/73 |
| 4,596,754 | 6/1986 | Tsutsui et al. | 430/49 |
| 4,618,552 | 10/1986 | Tanaka et al. | 430/60 |
| 4,623,609 | 11/1986 | Harita et al. | 430/325 |
| 4,654,285 | 3/1987 | Nishiguchi | 430/69 |
| 4,741,918 | 5/1988 | Nagy de Nagybaczon et al. | 427/11 |
| 4,797,337 | 1/1989 | Law et al. | 430/58 |
| 4,904,557 | 2/1990 | Kubo | 430/56 |
| 4,965,155 | 10/1990 | Nishiguchi et al. | 430/58 |
| 5,004,662 | 4/1991 | Mutoh et al. | 430/59 |
| 5,051,328 | 9/1991 | Andrews et al. | 430/56 |
| 5,069,758 | 12/1991 | Herbert et al. | 205/73 |
| 5,089,908 | 2/1992 | Jodoin et al. | 359/212 |
| 5,096,792 | 3/1992 | Simpson et al. | 430/58 |
| 5,238,467 | 8/1993 | Hashiba et al. | 51/293 |
| 5,332,643 | 7/1994 | Harada et al. | 430/127 |

FOREIGN PATENT DOCUMENTS

| | | |
|---|---|---|
| 60-112049 | 6/1985 | Japan . |
| 2-087154 | 3/1990 | Japan . |
| 2-191963 | 7/1990 | Japan . |
| 4-241358 | 8/1992 | Japan . |
| 4-269760 | 9/1992 | Japan . |
| 4-300163 | 10/1992 | Japan . |
| 2 224 224 | 5/1990 | United Kingdom . |

OTHER PUBLICATIONS

Patent Abstracts of Japan No. 58–17105.
Patent Abstracts of Japan No. 59–158.
Patent Abstracts of Japan No. 59–204048.
Patent Abstracts of Japan No. 62–186270.
Patent Abstracts of Japan No. 61–42663.
Patent Abstracts of Japan No. 60–86550.
Patent Abstracts of Japan No. 60–79360.
Patent Abstracts of Japan No. 58–162975.

*Primary Examiner*—John S. Y. Chu
*Attorney, Agent, or Firm*—Oliff & Berridge

[57] ABSTRACT

A process for producing an electrophotographic photoreceptor having a roughened substrate surface by wet honing the substrate surface with a composition including deionized water and substantially spherical glass beads. The process produces a photoreceptor substrate that eliminates interference fringe effects caused by reflection of coherent light without creating other printing defects such as white or black spots. A wet honing composition for producing such photoreceptors is also provided.

14 Claims, 4 Drawing Sheets

LIQUID HONING PROCESS AND COMPOSITION FOR INTERFERENCE FRINGE SUPPRESSION IN PHOTOSENSITIVE IMAGING MEMBERS

FIELD OF THE INVENTION

This invention relates to a process for surface treating electrophotographic photoreceptor substrates, substrates produced according to such a process and a composition for treating substrates.

BACKGROUND

Recently, coherent illumination has been increasingly used in electrophotographic printing for image formation on photoreceptors. Unfortunately, the use of coherent illumination sources in conjunction with multilayered photoreceptors results in a print quality defect known as the "plywood effect" or the "interference fringe effect." This defect consists of a series of dark and light interference patterns that occur when the coherent light is reflected from the interfaces that pervade multilayered photoreceptors. In organic photoconductor (OPC) photoreceptors, primarily the reflection from the air/charge transport layer interface (i.e., top surface) and the reflection from the undercoat layer or charge blocking layer/substrate interface (i.e., substrate surface) account for the interference fringe effect. The effect can be eliminated if the strong charge transport layer surface reflection or the strong substrate surface reflection is eliminated or suppressed.

Many methods have been proposed to suppress the charge transport layer/air interface reflection, including roughening of the charge transport layer surface by introducing $SiO_2$ and other particles into the charge transport layer, applying an appropriate overcoating layer and the like.

Many methods have been proposed to suppress the intensity of substrate surface reflection, e.g., coating methods such as anti-reflective coating and scattering material coating, and roughening methods such as anodization, dry blasting and wet honing. However, such methods must achieve their primary objective of eliminating substrate surface reflection without adversely impacting the electrical parameters or print quality of photoreceptors.

Patents on interference fringe effect suppression in general, or via suppression of the substrate surface reflection include U.S. Pat. No. 4,618,552 to Tanaka et al. (adding an opaque conductive layer above the ground plane), U.S. Pat. No. 4,741,918 to Nagy de Nagybaczon et al. (coating process using a buffing wheel), U.S. Pat. No. 4,904,557 to Kubo et at. (roughened photosensitive layer on top of a smooth substrate surface), U.S. Pat. No. 4,134,763 to Fujimura et. al. (grinding method to roughen the substrate surface), U.S. Pat. No. 5,096,792 to Simpson et al. (addition of antireflection layer on top of the substrate surface), U.S. Pat. No. 5,051,328 to Andrews et al. (Indium Tin Oxide transparent ground plane as the substrate), U.S. Pat. No. 5,089,908 to Jodoin et al., U.S. Pat. No. 5,069,758 to Herbert et al. and U.S. Pat. No. 4,076,564 to Fisher.

Photoreceptor substrate surfaces have been roughened by propelling ceramic and glass particles against a surface. Generally, these particles have a random particle size distribution and often have an irregular shape. For example, GB 2,224,224-A discloses an abrasive spray treatment of an electrophotographic photoreceptor substrate that hones the substrate to a satinized finish so as to eliminate interference fringe patterns and the formation of white or black spots.

However, this patent application teaches away from the use of glass beads as an abrasive agent because glass beads are too spherical and tend to produce a surface that, according to this patent application, is undesirably smooth and has higher glossiness, which tends to cause an interference fringe pattern.

Because of random particle size distributions, the smaller particles used in roughening processes are often embedded into the surface of the roughened substrate. These small particles can cause black or white spots in the final electrophotographic image. Black spots occur in reversal development systems, wherein the discharged areas of an exposed photoreceptor are developed with toner particles. White spots occur in positive development systems, wherein the charged areas of an exposed photoreceptor are developed with toner particles. Also, the embedded particles are often released from the substrate during subsequent coating operations and contaminate the coating compositions that are applied to form the final photoreceptors. In addition, large particles used in the roughening process can cause large craters to form in the substrate surface, which adversely affect the thickness uniformity of the subsequently applied photoreceptor coatings.

When the particles used for roughening have an irregular shape, tiny fragments tend to break away from the particles and embed into the surface of the substrate due to the concentration of pressure during impact, particularly along the sharp edges of the particles. Moreover, small fragments that are broken away from the particles that do not lodge in the substrate surface often tenaciously adhere to the surface of the substrate due to electrostatic attraction or other phenomena and are difficult to remove prior to application of coatings. Further, control of the surface texture of the substrate is difficult, if not impossible, because the particles having an irregular shape cause the formation of an irregular texture with uneven depressions of many different sizes and shapes.

The embedded or tightly adhering fragments from the particles cause non-uniform coverage by subsequently applied coatings such as undercoating layers and charge generating layers. This, in turn, can cause black spots in the final electrophotographic images due to charge injection discharge of areas that normally retain a charge during discharged area (reversal) development. For charged area (positive) development, the defect appears as a white spot in the final xerographic image. In addition, the sharp edges on depressions can cause high fields to form during imaging, which, like the embedded or tightly adhering fragments, leads to the formation of black spots for reversal development or white spots for positive area development. Also, the deposited undercoating layers are non-uniform and uneven when applied over particle fragments or over deep depressions having sharp edges. Air bubbles can be formed when undercoating layers are applied to deep craters having sharp edges, and these air bubbles adversely affect coating uniformity.

Although materials such as ceramic materials can be shaped into a spherical shape, such shaping is complex, difficult and expensive. Moreover, ceramic materials such as those made from aluminum oxide are difficult to dispose of in an environmentally acceptable manner.

SUMMARY OF THE INVENTION

The present invention has among its objects, provision of a process for eliminating the interference fringe effect in electrophotographic reproduction, a photoreceptor substrate that eliminates interference fringe effects caused by reflection of coherent light and a wet honing composition for producing such photoreceptor substrates.

The present process avoids adhesion of particle fragments to surfaces of the imaging member substrate during surface roughening. Consequently, photoreceptor substrates produced according to the process avoid the formation of black spots during reversal imaging and the formation of white spots during positive imaging. The lack of adhering particle fragments also promotes the formation of more uniform coatings and minimizes contamination of applied coatings.

The wet honing composition for producing such photoreceptor substrates utilizes economical, environmentally friendly materials.

The foregoing objects and others are accomplished in accordance with this invention by providing a process for roughening the surface of a substrate comprising aluminum or aluminum alloy for an electrophotographic imaging member comprising providing a wet honing composition comprising substantially spherical glass beads and deionized water and spraying the wet honing composition against the surface of the substrate at a honing media pressure of between about 3.0 and about 4.0 kg/cm$^2$, wherein the glass beads have a Knoop hardness of about 300 to about 750 kg/mm$^2$, a radius of curvature of particles greater than about 10 micrometers and less than about 35 micrometers and a specific gravity of about 1.8 to about 3.2, to form a scalloped pattern on the surface of the substrate. After roughening, the substrate can be coated with a photosensitive layer.

DETAILED DESCRIPTION OF PREFERRED EMBODIMENTS

Any suitable, substantially spherical glass beads may be utilized in the process of this invention. Preferably, the glass beads have a minimum radius of curvature of about 10 micrometers and a maximum radius of curvature of about 35 micrometers. In a preferred embodiment, the glass beads have a minimum radius of curvature of about 12.5 micrometers and a maximum radius of curvature of about 20 micrometers. When the substantially spherical glass beads have a radius of curvature of less than about 10 micrometers, the beads have a greater tendency to fracture and embed into the surface of the substrate during spraying. When the substantially spherical glass beads have a radius of curvature greater than about 35 micrometers, they form undesirably large craters in the surface of the substrate. These overly large craters cause subsequently applied coatings to be nonuniform in thickness and surface coverage. Also, the overly large craters tend to form undesirably deep valleys or depressions, which adversely affect the uniformity of subsequently applied coatings. Non-uniform coatings and surface coverage in turn degrade the quality of images formed during electrophotographic imaging.

Figure 2A:
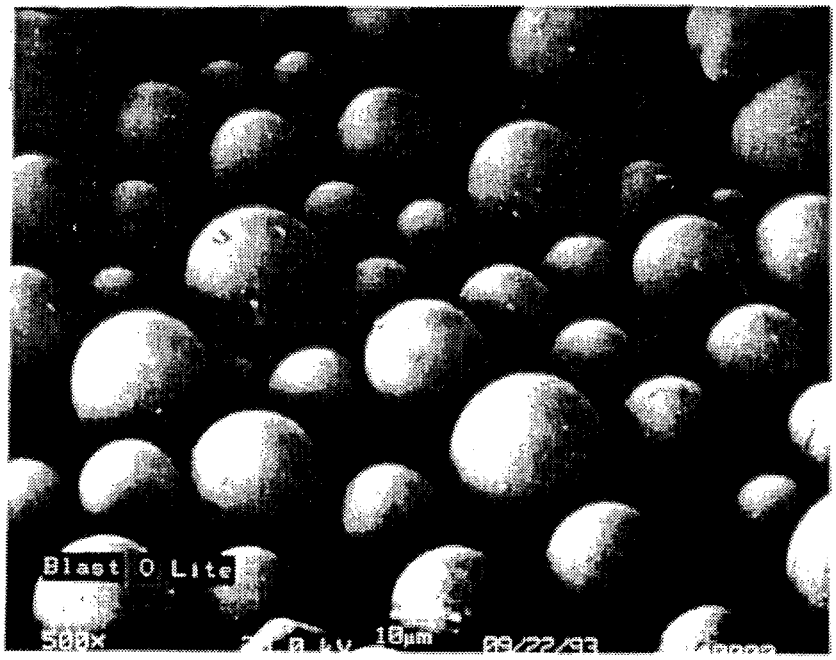
FIG. 2*a* is a scanning electron micrograph of spherical glass bead honing media that can be used in the present invention.

The substantially spherical glass beads utilized in the process of this invention have a rounded shape as shown in FIG. 2*a*. Typical rounded shapes include true spheres, ellipsoids, egg shapes, and other shapes free of sharp edges. Sharp edges can cause undesirable deep crevices in the surface of the substrate and can also promote bead fracturing, which in turn can lead to embedding of fractured particles in the surface of the substrate. The glass beads should be substantially free of components that dissolve in the deionized water employed in the wet honing composition of this invention. Thus, for example, the glass should be substantially free of ionizable material, which readily dissolves in the deionized water. A typical glass composition comprises, e.g., 72.5% $SiO_2$, 15% $Na_2O$, 7% CaO, 4% MgO, 1% $Al_2O_3$ and other trace components.

The glass beads should have a Knoop hardness of between about 300 and about 750 kg/mm$^2$, preferably between about 320 kg/mm$^2$ and about 610 kg/mm$^2$, to ensure proper formation of the desired craters in the substrate. The glass beads should also have a specific gravity between about 1.8 and 3.2, preferably between about 2.4 and about 2.8 for adequate inertia at the spray pressure utilized to form the scalloped pattern on the surface of the substrate.

Figure 2B:
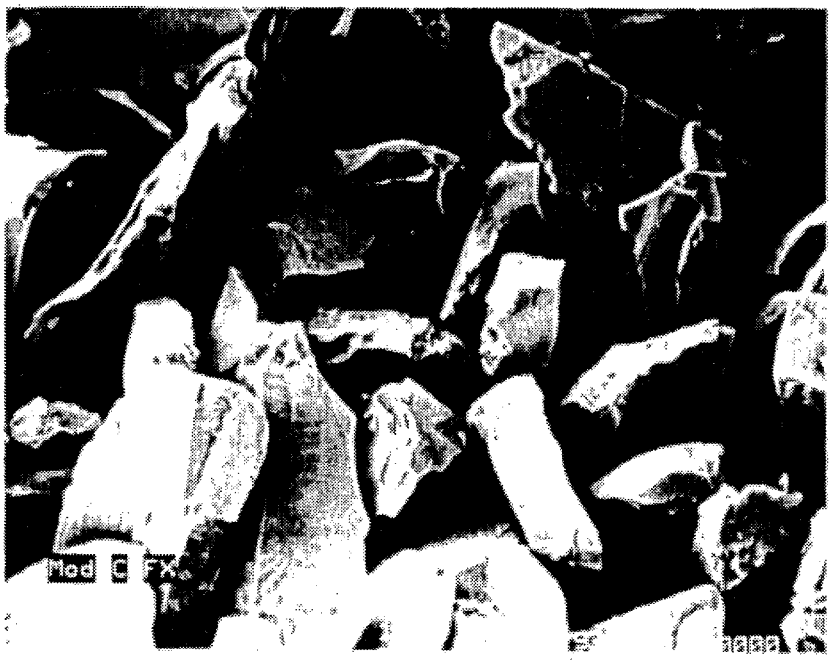
FIG. 2*b* is a scanning electron micrograph of $Al_2O_3$ honing media that have been used in the prior art.

Glass beads are superior to crystalline particles because they resist fracturing during impact with the substrate. Crystalline particles tend to shatter along cleavage planes and have sharper regular outer surfaces, as shown by the alumina particles in FIG. 2*b*, which concentrate pressure, whereas glass beads are amorphous, as shown in FIG. 2*a*, and have rounded surfaces that distribute the pressures created during impact with the substrate.

The wet honing composition utilized in the process of this invention comprises glass beads and deionized water that is substantially free of dissolved ions. Generally, satisfactory results may be achieved where the weight percentage of glass beads in the wet honing composition is between about 10 wt. % and about 30 wt. %. Preferably, 11–12 wt. % glass beads are present in the wet honing composition. When the glass bead wt. % is less than about 10 wt. %, non-uniform surface texture tends to develop during the honing process. When the glass bead wt. % is greater than about 30 wt. %, again, nonuniform surface texture tends to develop during the honing process.

Any suitable aluminum or aluminum alloy substrates may be treated with the process of this invention. Typical aluminum alloys include, for example, 1050, 1100, 3003, 6061, 6063, and the like. Alloy 3003 contains Al, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. The size and distribution of inclusions and intermetallic compounds in the alloy should be below the level at which the inclusions and intermetallic particles would pose a problem for the honing process. Nonuniform surface texture with patches of unhoned regions may result if many large inclusions or intermetallics are present. Similarly, the ductility properties of the aluminum substrate should be substantially uniform to ensure a uniform texture upon completion of the wet honing process. Generally, the surface of the aluminum substrate is relatively smooth prior to wet honing. Typical smooth surfaces are formed by, e.g., diamond lathing, specialized extrusion and drawing processes, grinding, buffing and the like. After smoothing, the substrate surface roughness should be in the range of about $R_a$=0.005 micrometers, $R_{max}$=0.05 micrometers to about $R_a$=0.13 micrometers, $R_{max}$=1.3 micrometers. The surface roughness, $R_a$, is well known and is the arithmetic average of all departures of the roughness profile from the center line within the evaluation length. The formula $R_a$ is as follows:

$$Ra = 1/Im \int_0^{Im} |y| dx$$

in which lm represents the evaluation length, and |y| represents the absolute value of departures of the roughness profile from the center line. The expression $R_{max}$ represents the largest single roughness gaps within the evaluation length. The evaluation length is that part of the traversing length that is evaluated. An evaluation length containing five consecutive sampling lengths is taken as a standard. These measurements may be made with a profilometer such as Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 5 microns.

Typically, the aluminum substrate is cylindrical or drum-shaped, and is cleaned by any suitable technique prior to wet honing to remove any foreign substances introduced to the Al surface during any of the aforementioned smoothing processes. Although FIG. 1 depicts a cylindrical substrate, as long as honing process parameters are met, any substrate geometry such as a hollow or solid cylinder, a flat sheet, a seamed or unseamed belt, or any other form that allows the utilization of conventional coating techniques such as dip coating, vapor deposition and the like can be used.

Figure 1:
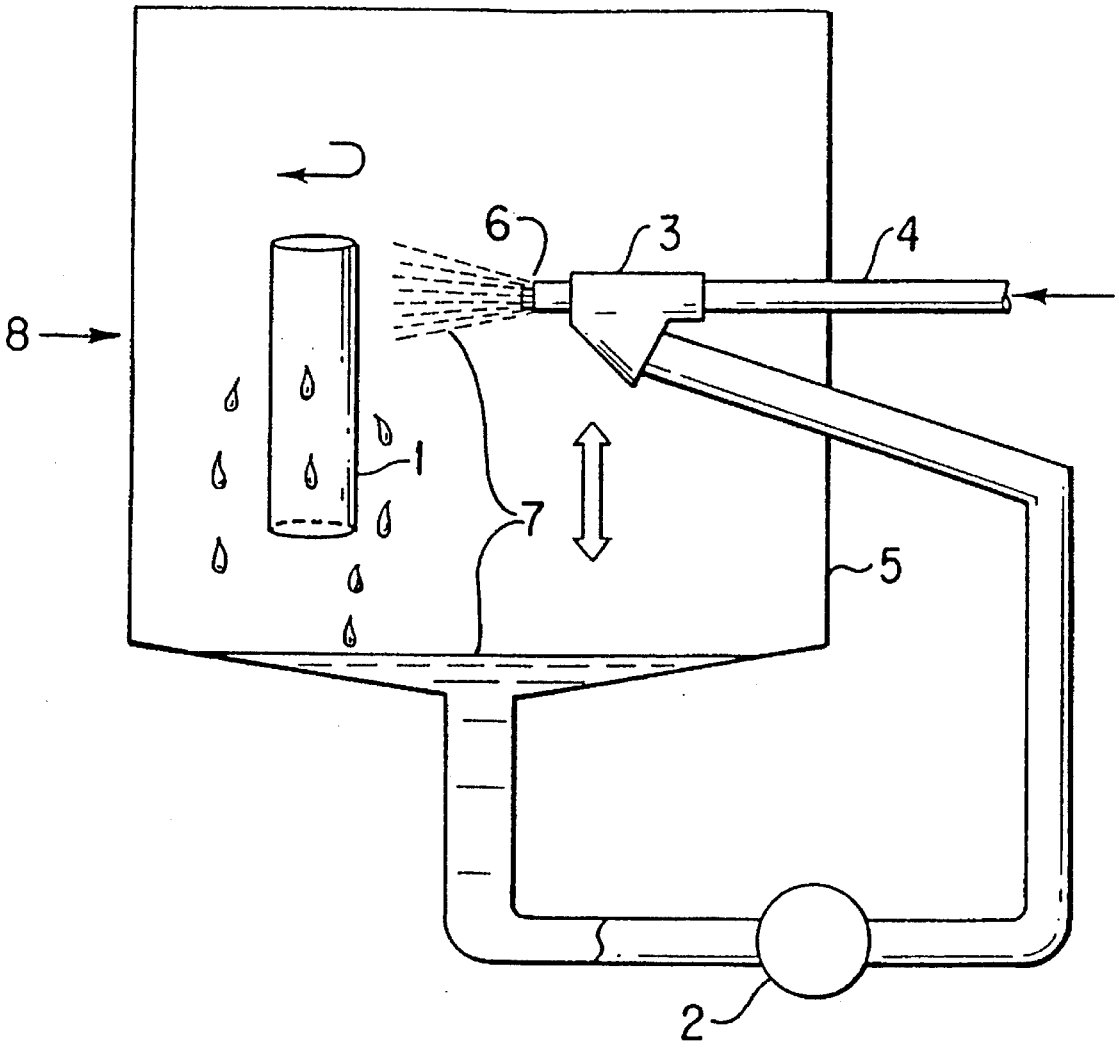
FIG. 1 is a schematic view of a wet honing apparatus that can be used in the present invention.

FIG. 1 depicts a typical wet honing process according to the present invention, wherein a spray gun 3 sprays a wet honing composition 7 at the surface of a cylindrical substrate 1. The distance between the spray gun 3 and the substrate to be treated is between about 140 mm (5.5 inches) and about 178 mm (7 inches). The cylindrical substrate 1 is rotated about its axis at a surface speed of between about 12 cm/sec and about 35 cm/sec (for the product sizes tested) or about 80 rpm. Typical glass bead concentration in the wet honing composition 7 is about 10 to 12 percent by weight glass bead and the remainder deionized water. The pressure applied through a tube 4 to the honing composition 7 as it is fed to the spray gun 3 is about 3.0 to about 4.0 kg/cm$^2$, preferably about 3.1 to about 3.8 kg/cm$^2$. The spray gun 3 is reciprocated at a speed of between about 250 mm/min and about 350 mm/min along an axis parallel to the axis of the cylindrical substrate 1. An acceptable scalloped pattern on the surface of the substrate 1 can be achieved in a single pass of the gun 3. These parameters are generally applicable to spray guns having a nozzle 6 of a diameter between about 7.9 mm and about 8.0 mm.

If desired, the ends of the cylindrical substrate 1 may be masked to prevent roughening of the area that is to remain free of coating material. Masking may be accomplished by any suitable technique that provides a shield between the substrate and the honing media.

Figure 3A:
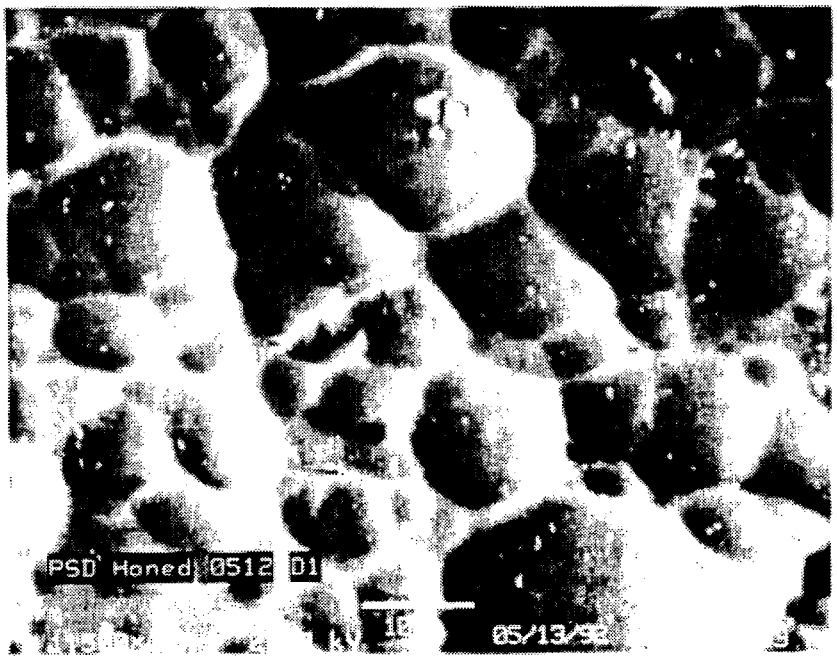
FIG. 3*a* is a scanning electron micrograph of an Al surface honed with classified glass bead honing media that can be used in the present invention.
Figure 3B:
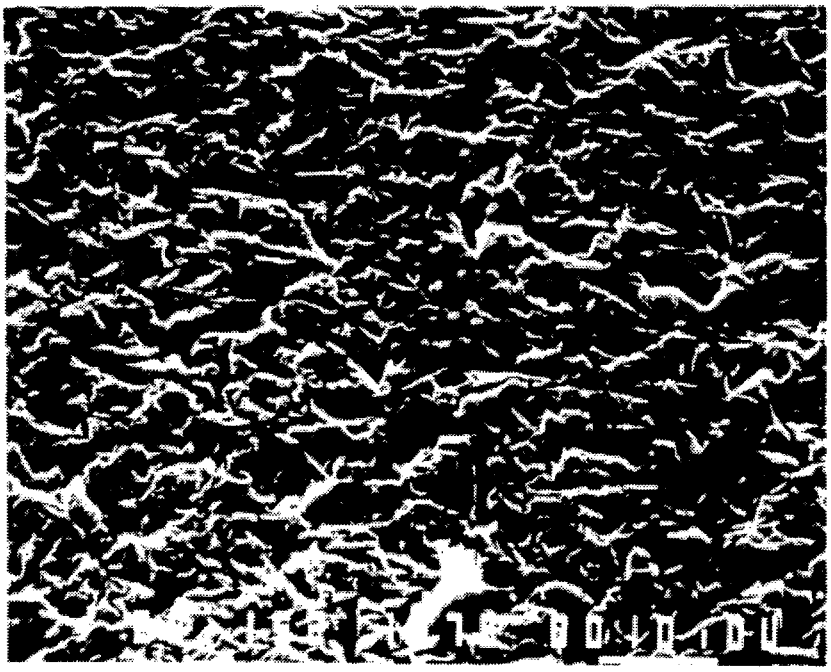
FIG. 3*b* is a scanning electron micrograph of an Al surface honed with irregular alumina media that have been used in the prior art.
Figure 4A:
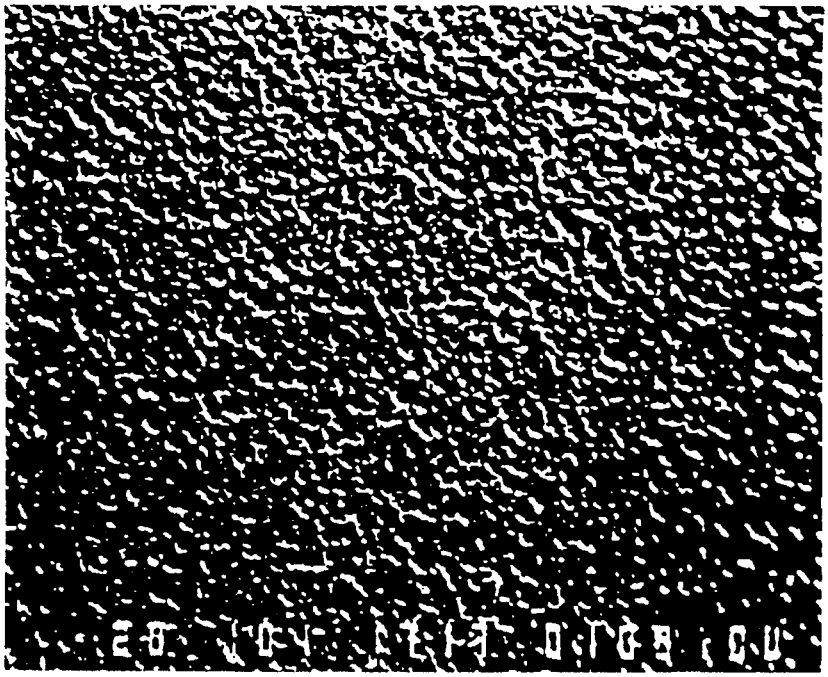
FIG. 4*a* is a scanning electron micrograph of an Al surface honed with classified glass bead honing media that can be used in the present invention, at a lower magnification than that of FIG. 3(*a*).
Figure 4B:
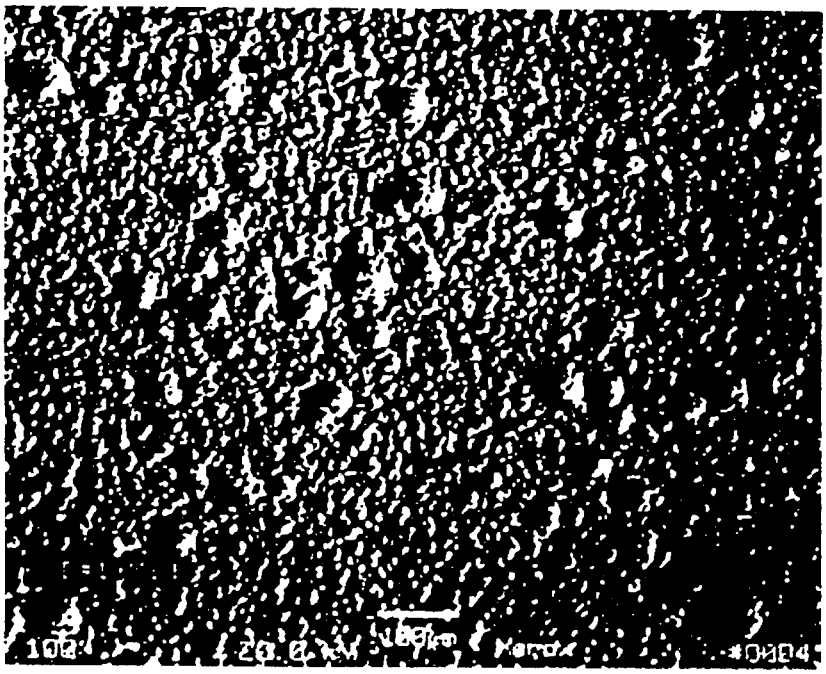
FIG. 4*b* is a scanning electron micrograph of an Al surface honed with unclassified glass honing media that have been used in the prior art.

As shown in FIGS. 3*a* and 4*a*, the surface of the substrate after completion of the wet honing process exhibits a scalloped pattern having a uniform, controlled surface roughness, free of embedded particles or large craters produced by prior art honing media, as shown in FIGS. 3*b* and 4*b*. This surface structure is also free of sharp crevices where protruding edges can adversely affect the uniformity of the undercoating layer and charge generating layer, as shown in FIG. 3*b*. Optimum results are achieved when the surface profile of the treated substrate has an $R_a$ mean roughness of between about 0.1 and about 1 micrometer and a $R_{max}$ roughness depth between about 2 and upto about 8 micrometers. The roughened surface of the substrate to achieve the process of this invention is always cratered. The mean of the maximum widths of the craters is preferably between about 10 micrometers and about 20 micrometers. A crater having a width of at least about 30 micrometers has been found to be too large for achieving satisfactory coating uniformity. The craters are shallow and are much smaller than a true hemisphere. Generally, the craters each have a maximum depth of about 0.5 to 3.0 micrometers.

When non-deionized water is utilized in the wet honing composition, etching of the substrate can occur. Etching is characterized by a hazy appearance. Etching is undesirable because etched surfaces lead to substrate surface defects, such as stains, that are visible through coating. Also, non-deionized water can produce undesirable impurities that adversely affect xerographic properties of the final electrophotographic imaging member. For example, non-deionized water can form adverse effects on the substrate, which appear on the final xerographic print as water marks. The presence of impurities in non-deionized water causes variations in the chemical characteristics along the surface of the substrate, which causes nonuniform electrical properties along the surface of the final electrophotographic imaging member, which in turn results in nonuniform discharge for exposure conditions. Surprisingly, these nonuniform surface features persist even after subsequent washing of the substrate prior to the application of coating materials. Thus, the ion content of the honing slurry should be less than ppm levels.

The invention will be illustrated in more detail with reference to the following Example, but it should be understood that the present invention is not deemed to be limited thereto.

EXAMPLE

Glass beads having a Knoop hardness of about 360–420 kg/mm$^2$ and an approximate composition of 72.5% $SiO_2$, 15% $Na_2O$, 7% CaO, 4% MgO, 1% $Al_2O_3$ are obtained from Upstate Metal Finishing, Ontario, N.Y. The beads are classified using a 90 micron screen to eliminate particles with a radius of curvature larger than 45 microns. The starting material is such that there are effectively no beads with a radius of curvature greater than 35 microns. 5.85 kilograms of classified beads are suspended in 49.2 L of deionized water at ambient temperature to prepare an approximately 12 wt. % suspension.

An aluminum alloy (type 3003) cylinder suitable for use as a photoreceptor substrate is masked at both ends with Delrin®, an acetal resin manufactured by Du Pont, and inserted between opposing mandrels in a vapor honing chamber of a vapor honing apparatus, as depicted in FIG. 1. The vapor honing chamber 5 is sealed prior to honing the cylinder 1. The cylinder 1 is rotated axially at a velocity of 80 rpm.

The spray gun 3 is aimed at one end of the cylinder 1 at a fixed distance of 178 mm (7 in). The glass bead suspension 7 is fed by a pump 2 to the spray gun 3, and a pressure of 3.5 kg/cm$^2$ (50 psi) is applied through the pipe 4 to spray the suspension 7 at the cylinder 1. After about 5 seconds of pressure application, the spray gun 3 is moved at a rate of 35 cm/min (13.78 ips) toward the opposite end of the cylinder 1 along an axis parallel to the axis of the cylinder 1. After reaching the opposite end of the cylinder 1, the pressure, the movement of the spray gun 3 and the rotation of the cylinder 1 are stopped. The resulting honed cylinder 1 is removed from the vapor honing apparatus and immersed in an ambient deionized water vat, being careful not to contact the honed surface of the cylinder 1 with anything other than deionized water (and, of course, air) throughout the balance of the process.

The cylinder is transferred from the water vat to a spray rinse tank, where the cylinder is sprayed with deionized water (2 Mohm-cm) at ambient temperature for 1 minute at a rate of 16 liters/min. The cylinder is transferred from the spray rinse tank to a recirculating ultrasonic treatment tank, where the cylinder is immersed at a rate of 7.62 mm/min in deionized water (2 Mohm-cm) at ambient temperature, which is recirculated at a rate of 37.85 liters/min. After 60 seconds of immersion, recirculation is stopped, and ultrasonic treatment occurs for 40 seconds. A Ney ultrasonic unit is employed at approximately the following conditions: 40 KHz at a bandwidth of 2 KHz, a sweep time of 1 sec., a train time of 1 sec., a degas time of 0.03 sec., a burst time of 0.01 sec., and a quiet time of 0.01 sec. After ultrasonic treatment, recirculation is restarted and, after 30 seconds, the cylinder is removed from the water at a rate of 7.62 mm/min. The cylinder is transferred to a hot deionized water (2 Mohm-cm) rinse tank having a water temperature of 70° C. The cylinder is lowered into the water at a rate of 7.62 mm/min and rinsed for 30 seconds in the recirculating (37.85 liters/min) water. After rinsing, the cylinder is removed from the water at a rate of 7.62 mm/min. The cylinder is allowed to dry and cool for 15 seconds, yielding a cleaned honed substrate for a photoreceptor that eliminates interference fringe effects caused by reflection of coherent light without creating other printing defects such as white or black spots or substrate stains.

The aforementioned substrate may be finished with an intermediate layer and/or a photosensitive layer as follows.

One or more intermediate layers may be employed in embodiments of the present invention. The intermediate layer may be any layer conventionally employed between the substrate and the photosensitive layer as illustrated for example in Tanaka et al., U.S. Pat. No. 4,618,552 and Andrews et al., U.S. Pat. No. 5,051,328, the disclosures of which are totally incorporated by reference. Accordingly, the intermediate layer may be a subbing layer, barrier layer, adhesive layer, and the like. The intermediate layer may be formed of, for example, casein, polyvinyl alcohol, nitrocellulose, ethyleneacrylic acid copolymer, polyamide (nylon 6, nylon 66, nylon 610, copolymerized nylon, alkoxymethylated nylon, and the like), polyurethane, gelatin, and the like. In embodiments, intermediate adhesive layers between the substrate and subsequently applied layers may be desirable to improve adhesion. Typical adhesive layers include film-forming polymers such as polyester, polyvinylbutyral, polyvinylpyrrolidone, polycarbonate, polyurethane, polymethyl methacrylate, and the like as well as mixtures thereof. The intermediate layer may be deposited by any conventional means such as dip-coating and vapor deposition and preferably has a thickness of from about 0.1 to about 5 microns.

In embodiments, a charge transport layer and a charge generating layer comprise the photosensitive layers. This is referred to as a laminate type photosensitive material. Charge transport and charge generating layers may be deposited by any suitable conventional technique including dip coating and vapor deposition and are well known in the art as illustrated for example in U.S. Pat. Nos. 4,390,611, 4,551,404, 4,588,667, 4,596,754, and 4,797,337, the disclosures of which are totally incorporated by reference. In embodiments, the charge generation layer may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the charge transport layer may be formed by dissolving a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

In embodiments, the photosensitive material may be of a single-layer type comprising the charge generating material, charge transporting material, and the binder resin, wherein these three materials may be as described above. Single layer type photosensitive materials may be deposited by any suitable technique including dip coating and vapor deposition and are illustrated, for example, in Mutoh et al., U.S. Pat. No. 5,004,662 and Nishiguchi et al., U.S. Pat. No. 4,965,155, the disclosures of which are totally incorporated by reference.

The photosensitive imaging member produced according to the invention is tested for print quality assessment in Xerox laser printer model 4213 at an initial charging voltage of about 380 volts. The 4213 laser printer has a 780 nm wavelength laser diode as the exposure source and a single component discharged area development (DAD) system with 11 micron toners. Interference fringe effect is tested in a gray scale print mode using specified halftone patterns. The interference fringes, or plywood fringes, are not observed, and no degradation of print quality is observed due to black spots. Similar results may be achieved with other laser-based machines, e.g., those with an exposure light source that operates in the range of 600–800 nm.

While the invention has been described in detail and with reference to specific examples thereof, it will be apparent to one skilled in the art that various changes and modifications can be made therein without departing from the spirit and scope thereof.

What is claimed is:

1. A process for roughening a substrate surface in an electrophotographic imaging member, comprising providing a wet honing composition comprising deionized water and substantially spherical glass beads and spraying said wet honing composition against said substrate surface at a spraying pressure of between about 3.0 and about 4.0 kg/cm$^2$ to form a scalloped pattern on said substrate surface, wherein said substrate comprises aluminum or aluminum alloy and wherein said glass beads have:

a Knoop hardness of about 300 to about 750 kg/mm$^2$, a radius of curvature greater than about 10 micrometers and less than about 35 micrometers, and a specific gravity of about 1.8 to about 3.2.

2. A process according to claim 1, wherein said providing step comprises providing glass beads having an average radius of curvature of between about 12.5 micrometers and about 20 micrometers.

3. A process according to claim 1, wherein said providing step comprises providing glass beads having a Knoop hardness of about 320 to about 610 kg/mm$^2$.

4. A process according to claim 1, wherein said providing step comprises providing glass beads having a Knoop hardness of about 360 to about 420 kg/mm$^2$.

5. A process according to claim 1, wherein said providing step comprises providing glass beads having a specific gravity of about 2.4 to about 2.8.

6. A process according to claim 1, wherein said providing step comprises providing glass beads having the shape of a true sphere.

7. A process according to claim 1, wherein said providing step comprises providing glass beads having the shape of an egg.

8. A process according to claim 1, wherein said providing step comprises providing glass beams having the shape of an ellipsoid.

9. A process according to claim 1, wherein said spraying step forms craters on said substrate surface.

10. A process according to claim 9, wherein said craters have a depth of between about 0.5 micrometers and about 3 micrometers and a width of between about 10 micrometers and about 20 micrometers.

11. A process according to claim 1, wherein said spraying step comprises roughening said substrate surface to have an $R_a$ mean roughness of between about 0.1 and about 1 micrometer and an $R_{max}$ roughness depth between about 2 and about 8 micrometers.

12. A process according to claim 1, wherein said providing step comprises providing about 10 wt. % to about 30 wt. % of said glass beads in said wet honing composition.

13. A process according to claim 1, wherein said providing step comprises providing about 11 wt. % to about 12 wt. % of said glass beads in said wet honing composition.

14. A process according to claim 1, wherein said spraying step comprises spraying said wet honing composition at said substrate surface from a distance of between about 140 mm and about 178 mm.

* * * * *